US005815084A

United States Patent [19]

Lavelle et al.

[11] Patent Number: 5,815,084

[45] **Date of Patent: *Sep. 29, 1998**

[54] PROGRAMMER FOR CONTACT READABLE ELECTRONIC CONTROL SYSTEM AND PROGRAMMING METHOD THEREFOR

[75] Inventors: Gary E. Lavelle, Avon; George Frolov, Farmington, both of Conn.

[73] Assignee: Harrow Products, Inc., Grand Rapids, Mich.

[ * ] Notice: The term of this patent shall not extend beyond the expiration date of Pat. No. 5,537,103.

[21] Appl. No.: 656,401

[22] Filed: May 31, 1996

Related U.S. Application Data

[63] Continuation-in-part of Ser. No. 65,185, May 20, 1993, Pat. No. 5,537,103.

[51] Int. Cl.[6] ..... G08B 5/00

[52] U.S. Cl. ..... 345/825.31; 340/825.34; 340/825.32; 235/382; 235/382.5; 70/276; 70/277; 70/278

[58] Field of Search ..... 340/825.31, 825.34, 340/825.32; 70/276, 277, 278; 235/382, 382.5

[56] References Cited

U.S. PATENT DOCUMENTS 4,148,092 4/1979 Martin ..... 361/172
4,972,182 11/1990 Novik et al. ..... 340/825.32

*Primary Examiner*—Michael Horabik
*Assistant Examiner*—Youel Beaulieu
*Attorney, Agent, or Firm*—Alix, Yale & Ristas, LLP

[57] ABSTRACT

Programmers for an entry control system employ data carriers housing ROM chips. The ROM chips are affixed with unique elemental codes. A keypad addresses the chips in one-to-one correspondence with the keys to transmit the unique elemental codes to the programmable processor of the entry control system.

20 Claims, 14 Drawing Sheets

COMMAND LIST

BASIC:

| | |
|---|---|
| 1 2 | CHANGE USER CODE |
| 3 4 | ADD USER CODE |
| 5 6 | DELETE USER CODE |
| 7 8 | CHANGE MASTER CODE |

ADVANCED:

| | | | |
|---|---|---|---|
| | 1 2 | 1 2 | CHANGE USER CODE / FUNCTIONS |
| | 3 4 | 3 4 | ADD USER CODE / FUNCTIONS |
| | 5 6 | 5 6 | DELETE USER CODE WITH ALARM |
| | 7 8 | 7 8 | DISPLAY VERSION NUMBER |
| 7 8 | 7 8 | 7 8 | INITIALIZE PROGRAMMER |
| | | 9 0 | CONFIGURE SYSTEM |
| | 9 0 | 9 0 | CONFIGURE SYSTEM |
| 9 0 | 9 0 | 9 0 | CONFIGURE DELAY EGRESS |

FIG. 11

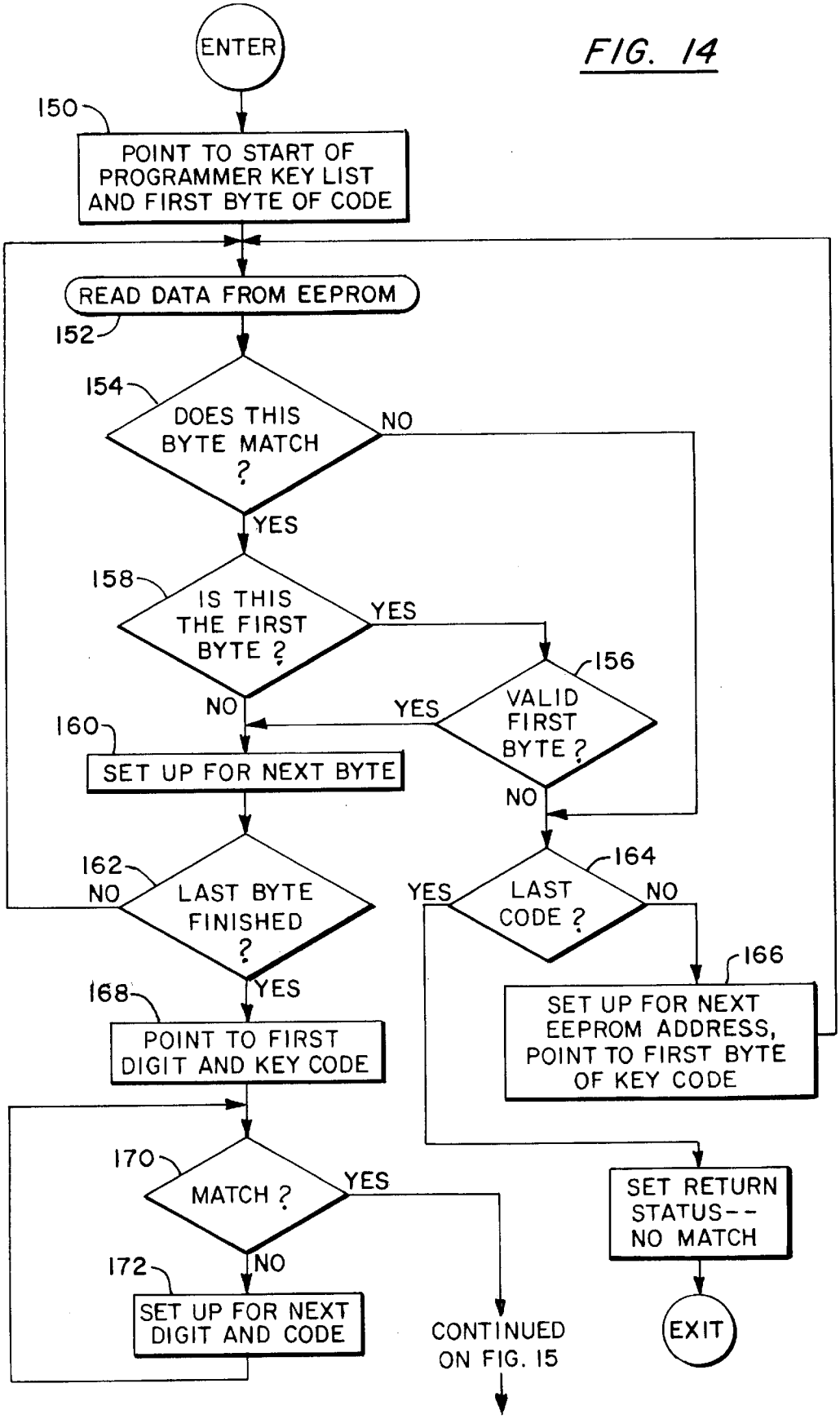
FIG. 14
ENTER
150
POINT TO START OF PROGRAMMER KEY LIST AND FIRST BYTE OF CODE
READ DATA FROM EEPROM
152
154
DOES THIS BYTE MATCH ?
NO
YES
158
IS THIS THE FIRST BYTE ?
YES
156
VALID FIRST BYTE ?
YES
NO
160
SET UP FOR NEXT BYTE
NO
162
NO
LAST BYTE FINISHED ?
YES
164
LAST CODE ?
YES
NO
166
SET UP FOR NEXT EEPROM ADDRESS, POINT TO FIRST BYTE OF KEY CODE
168
POINT TO FIRST DIGIT AND KEY CODE
170
MATCH ?
YES
NO
172
SET UP FOR NEXT DIGIT AND CODE
SET RETURN STATUS-- NO MATCH
EXIT
CONTINUED ON FIG. 15

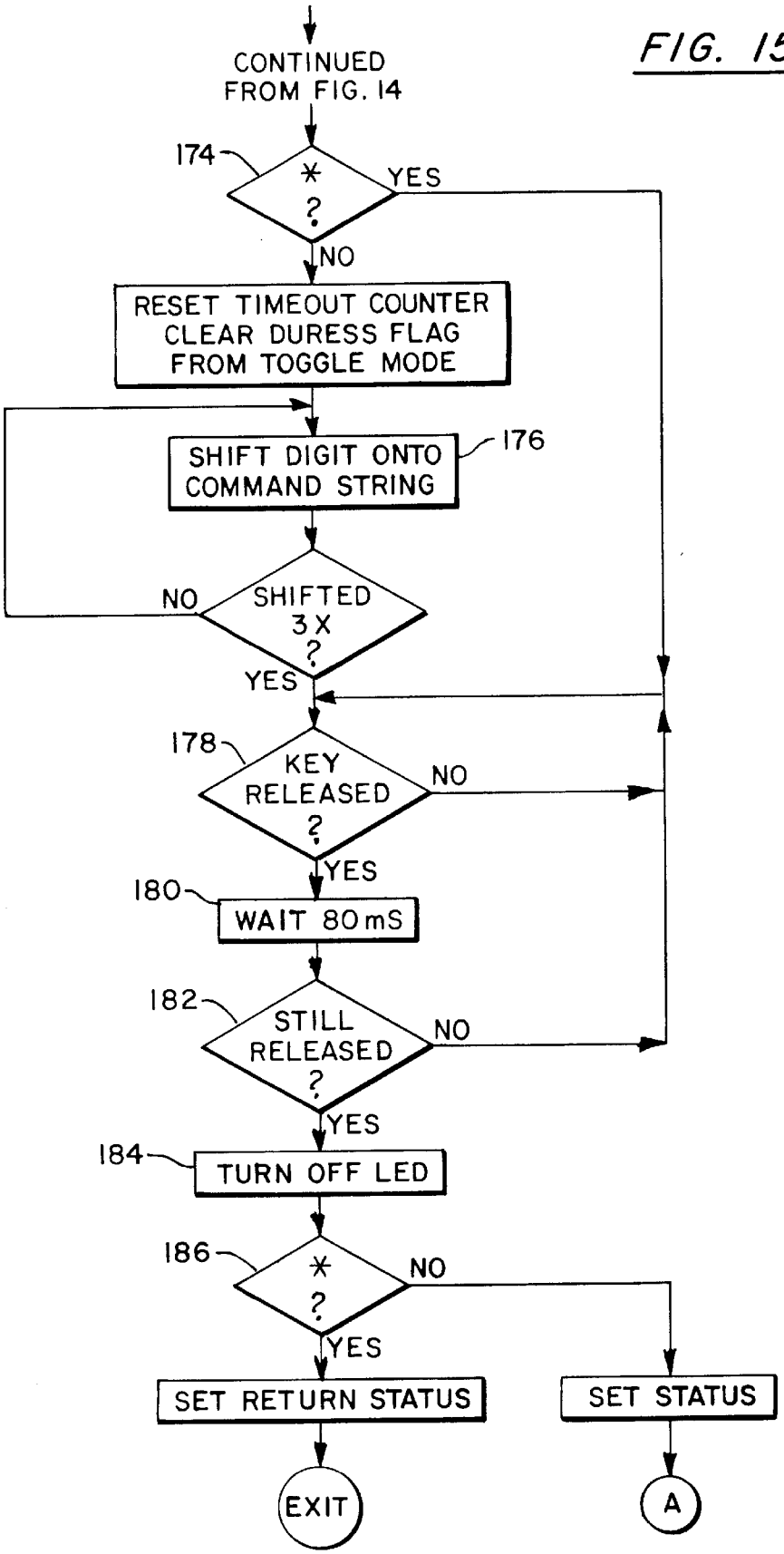
FIG. 15
CONTINUED FROM FIG. 14
174
*?
YES
NO
RESET TIMEOUT COUNTER
CLEAR DURESS FLAG
FROM TOGGLE MODE
SHIFT DIGIT ONTO COMMAND STRING
176
SHIFTED 3X ?
NO
YES
178
KEY RELEASED ?
NO
YES
180
WAIT 80mS
182
STILL RELEASED ?
NO
YES
184
TURN OFF LED
186
*?
NO
YES
SET RETURN STATUS
SET STATUS
EXIT
A

PROGRAMMER FOR CONTACT READABLE ELECTRONIC CONTROL SYSTEM AND PROGRAMMING METHOD THEREFOR

CROSS-REFERENCE TO RELATED APPLICATION

This application is a continuation-in-part of U.S. patent application Ser. No. 08/065,185 filed May 20, 1993, now U.S. Pat. No. 5,537,103.

BACKGROUND OF THE INVENTION

This invention relates generally to control systems which employ a reader to control access to a restricted area. More particularly, the present invention relates generally to control systems which employ a reader for receiving data upon contact by a data carrier having a memory chip.

Control systems to which the invention relates employ automatic electronic controllers. The controllers respond to readers which have an input receptacle. A data carrier having a memory chip which includes a pre-established data code is manually inserted into the receptacle. Upon contact, the code is read into the controller. The controller may be employed to generate suitable signals in response to the code to, for example, provide access through an entranceway, to control inventory, to record the presence of an individual at a given location, and numerous other applications.

A data carrier, such as a carrier marketed by Dallas Semiconductor as a DS 1990 Touch Serial Number, essentially functions as a key or an electronic serial number for automatic identification. The carrier includes a 64 bit ROM which stores data that is transferred serially upon contact with the reader. The carrier is coin-shaped and includes a durable stainless steel case. The carrier is typically mounted to a panel, a key ring, a clip, an adhesive pad, a photograph identification card or another accessory which facilitates portability and accessibility.

For applications wherein the controller functions to control access to an area, readers are installed adjacent to the entranceways. The reader electronically communicates with a programmable controller. The data carriers essentially function as keys. Upon contacting the key with the reader, the data from the carrier is serially input into the controller. Conventionally, the controller is programmed to accept or reject various data codes to correspondingly automatically provide access to the area. Typically, the controller generates a signal for releasing an electromagnetic lock or other electrically operated lock in response to a valid code or password. The time of entry and the identification of the individual entering may also be recorded by the controller.

A keypad is also commonly provided in conjunction with the reader. The keypad may function to input a personal access code or a supplemental code, or may be used to program the controller. For some automatic control systems, it may not be desirable in terms of cost, headroom constraints, security and other factors to provide a keypad with each reader—especially for access control systems where a large number of users must pass through an entranceway without delay. Access to a restricted area may be obtained through a relatively compact reader which primarily includes a LED and an input port in the form of a receptacle for mating with the data carrier.

In some automatic control systems to which the invention relates, one side of the entranceway contains an entry set which includes a keypad as well as a reader while the opposite side of the doorway has a reader but no keypad.

Both readers are connected with the controller, and programming is performed through the keypad. However, in numerous other systems—especially relatively low cost systems, none of the controlled sides of the entryway are provided with a keypad. While such systems may function in an efficient manner through use of a pre-programmed controller and a pre-established set of data carriers, flexibility for such a system is highly restrictive unless additional programming of the controller can be implemented on an ongoing basis.

Typically, these low cost systems can not be readily converted for programming at the door location by a permanently mounted programmer having a keypad for programming. Generally, the entire entry control system must be replaced with a more sophisticated and generally more expensive entry control system that is capable of being programmed from a keypad permanently mounted at the door location.

For entry and monitor control applications, it is highly desirable that the controller be programmable to delete or add codes as the set of authorized users is expanded, contracted or changed. Several devices have been employed to accomplish such programming. Among such devices are a cordless touch pen, a hand-held computer and a PC keyboard. Each of the foregoing are all employed to input commands to program the controller. For a basic control access system, minimal programming capability ordinarily consists of adding or deleting pass codes as keys are lost or as new keys are added to the system.

SUMMARY OF THE INVENTION

Briefly stated, the invention in a preferred form is a programmer that is particularly adapted for an entry control system for controlling access to a restricted area. The control system comprises a controller having a programmable processor for establishing a passcode and comparing an input code to the passcode and for selectively generating an output signal in response to the comparison. A contact activatable data port communicates with the processor. The data port is adapted for receiving an input from a ROM, a RAM or other memory chip upon contact with a case housing the chip.

The programmer comprises a plurality of ROM program chips each having a unique elemental code. The programmer communicates with the data port for programming the processor to redefine the passcode. A keypad is employed for selectively addressing each of the ROM program chips. The keypad in one embodiment, includes a membrane which overlays a plurality of electrical switches corresponding to each of the program chips. The programmer may further include a receptacle to provide a contact activatable data port which is communicable with a key for the control system. There are six program chips. The program chips are mounted in sockets on a board.

In an alternate embodiment, the programmer is a retrofit kit which permits a programmable entry control system to be programmed by a programmer having a keypad permanently mounted at the site of the doorway. The retrofit kit comprises an adapter module having a plurality of ROM program chips, each having a unique elemental code. A keypad for permanent mounting at the door site is employed for selectively addressing each of the ROM program chips. The keypad in one embodiment includes a plurality of depressible keys which active electrical switches corresponding to each of the program chips. The adapter module, by use of the keypad, communicates with the input of the processor to redefine the passcode. The keypad preferably further includes a receptacle to provide a contact activatable data port which is communicable with the programmable processor.

In a further embodiment of the retrofit kit, the programmer is employed for the input of personal identification codes to provide an additional level of security. The programmable processor of the controller establishes personal access codes and compares input personal access codes to the established personal access codes. The processor further generates an output signal in response to the comparison. The personal access codes are the unique elemental codes of the ROM program chips of the retrofit programmer. The personal access codes are communicated to the input of the controller by actuation of the keypad.

In another embodiment, the program chips are fixedly mounted to integral fingers of a flexible board. The chips are affixed with an elemental code which corresponds to a keypad designation. Identification for each of the ROM program chips is affixed to the opposite side of the board. Programming is accomplished by selecting the appropriate ROM program chip and inputting the code from the chip by direct contact with the input data of the control system.

An object of the invention is to provide a new and improved programmer and programming method for a contact reader control system.

Another object of the invention is to provide a new and improved hand-held programmer which can be employed to program a contact reader controller in an efficient and a reliable manner.

Another object of the invention is to provide a retrofit kit for an entry control system which kit includes a keypad and an adapter module permanently mountable at the site of the doorway.

A further object of the invention is to provide a new and improved compact programmer and programming method having a low cost and efficient construction which can be used to add or delete codes for an automatic entry control system.

A still further object of the invention is to provide a programmable door lock having a relatively inexpensive programmer permanently mounted at the site of each secured door.

Other objects and advantages of the invention will become apparent from the drawings and the specification.

BRIEF DESCRIPTION OF THE DRAWINGS

FIG. 11 is a table illustrating representative commands for the programmer of FIG. 1;

FIG. 14 is a flow chart illustrating a portion of a routine comparing carrier codes performed by the programmer of FIG. 1;

FIG. 15 is a flow chart illustrating a second portion of the routine for comparing codes of FIG. 14;

DETAILED DESCRIPTION OF THE PREFERRED EMBODIMENTS

Figure 1:
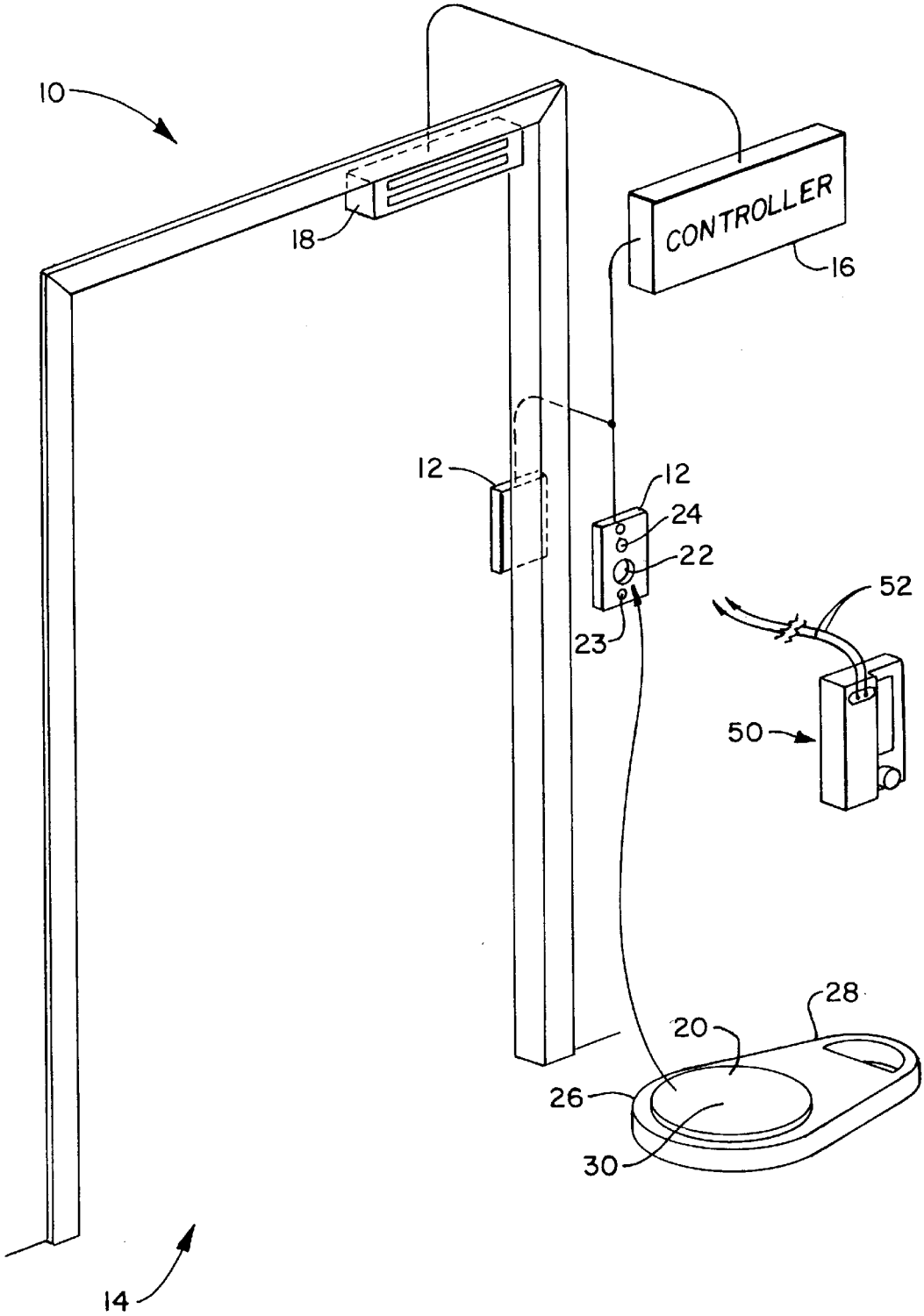
FIG. 1 is a schematic view of an access control system employing a programmer in accordance with the present invention.
Figure 2:
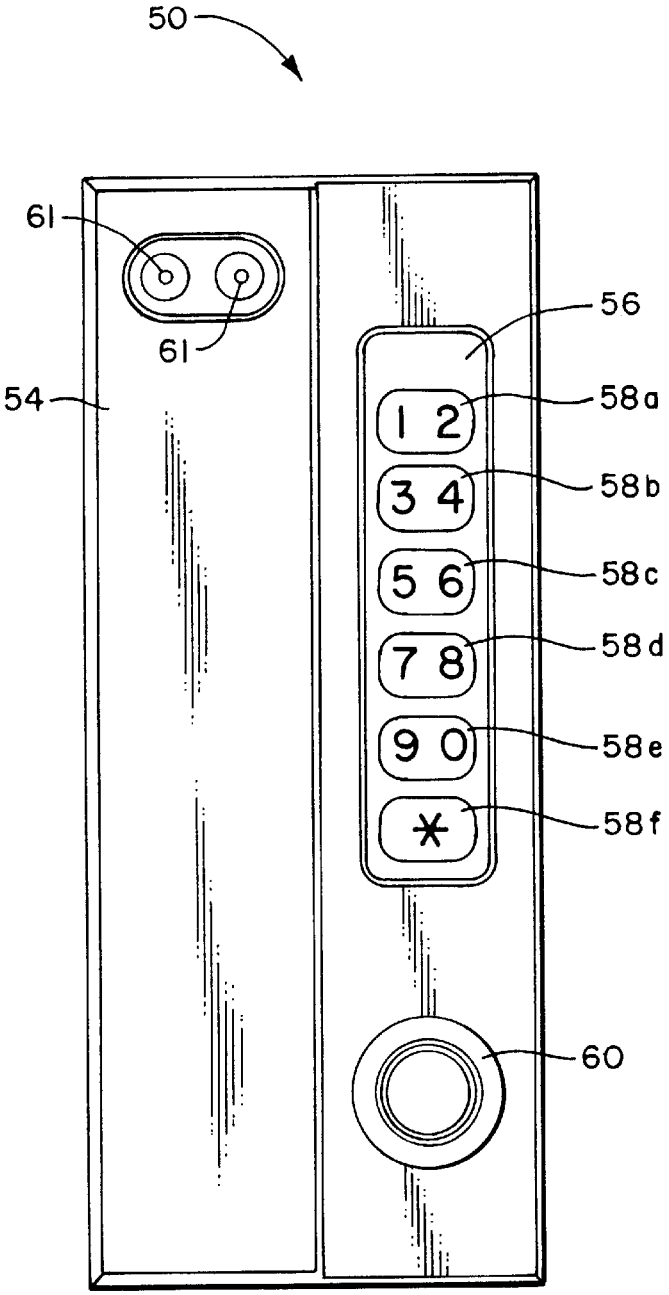
FIG. 2 is a top plan view of a programmer in accordance with the present invention.
Figure 3:
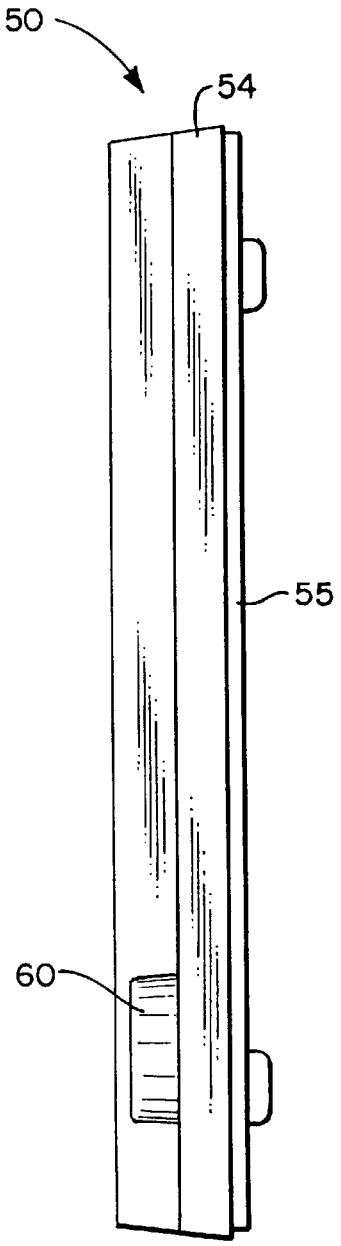
FIG. 3 is a side view of the programmer of FIG. 2 viewed from the right thereof.
Figure 4:
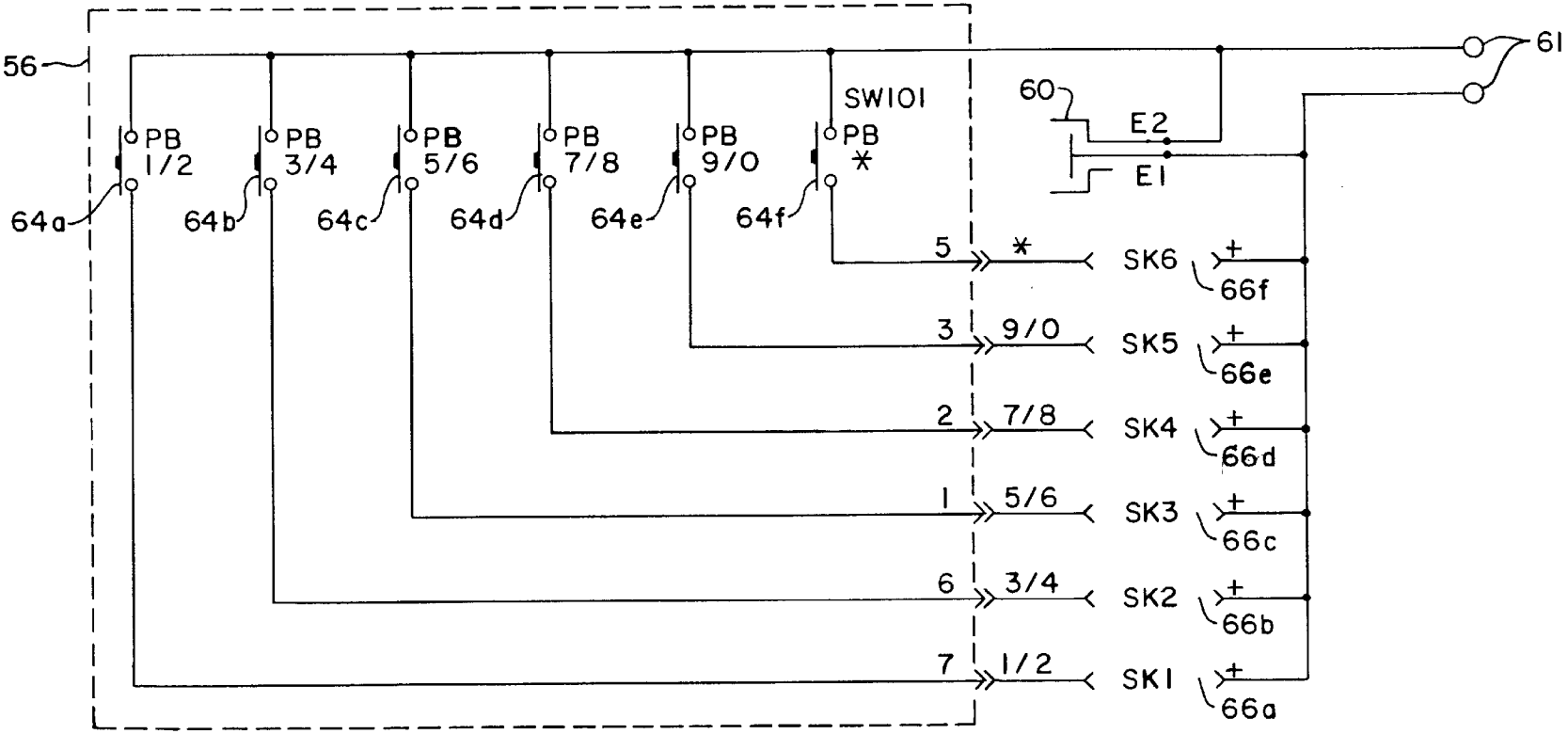
FIG. 4 is a schematic diagram of the circuitry for the programmer of FIG. 2.
Figure 5:
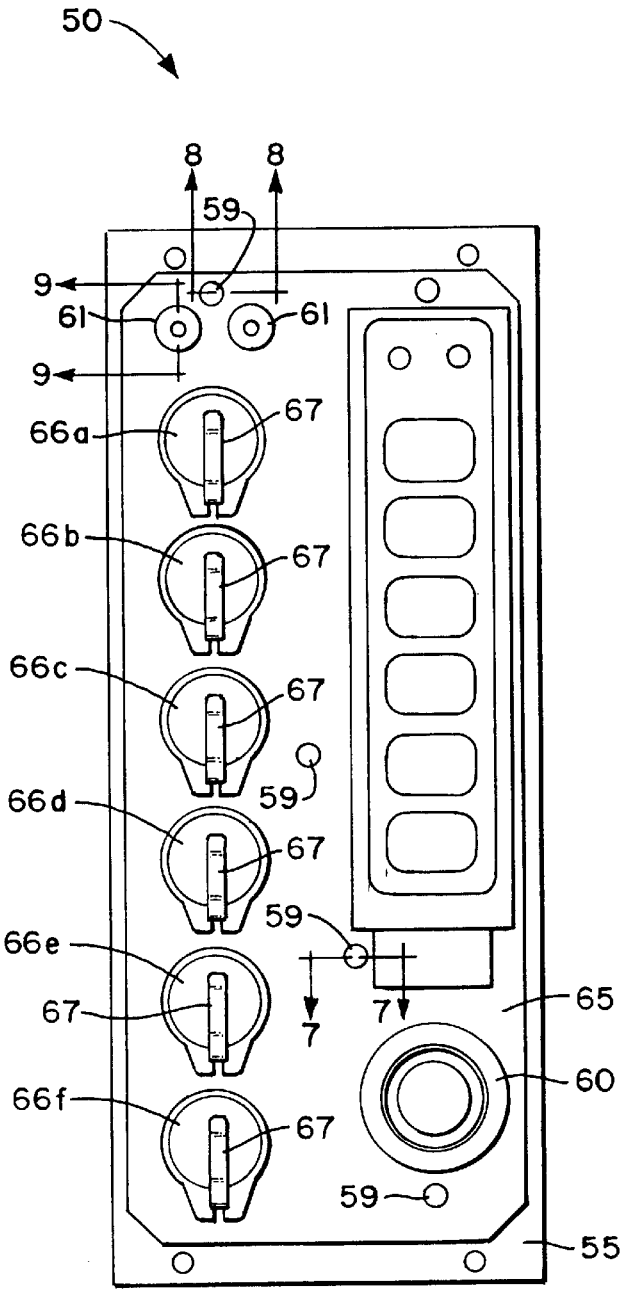
FIG. 5 is a top interior view of the programmer of FIG. 2 with the cover being removed.
Figure 6:
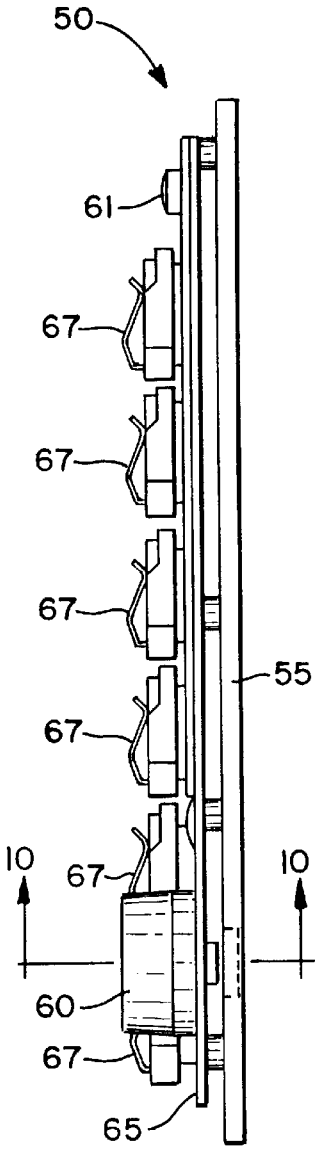
FIG. 6 is a side interior view of the programmer of FIG. 5 viewed from the right thereof.
Figure 7:
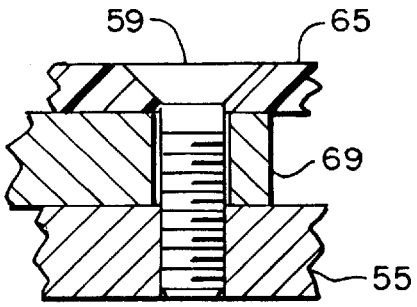
FIG. 7 is an enlarged fragmentary sectional view of the programmer of FIG. 5 taken along the line of 7—7 thereof.
Figure 8:
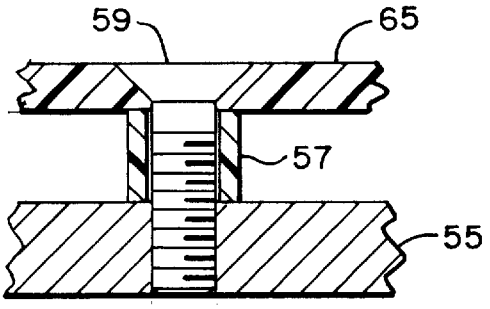
FIG. 8 is an enlarged fragmentary sectional view of the programmer of FIG. 5 taken along the line of 8—8 thereof.
Figure 9:
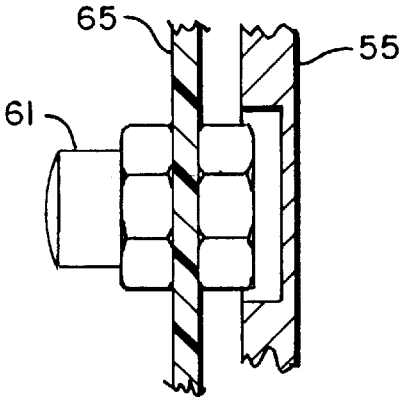
FIG. 9 is an enlarged fragmentary sectional view of the programmer of FIG. 5 taken along the line 9—9 thereof.
Figure 10:
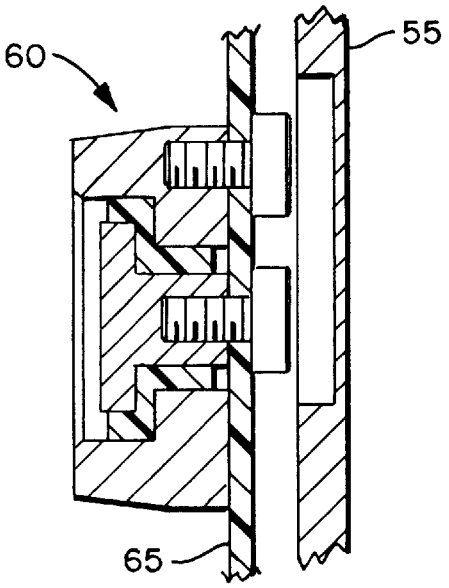
FIG. 10 is an enlarged fragmentary sectional view of the programmer of FIG. 6 taken along the line 10—10 thereof.

With reference to the drawings wherein like numerals represent like parts throughout the figures, an access control system is generally designated by the numeral 10 in FIG. 1. The access control system 10 includes a pair of reader modules 12 which are located at opposed sides of an entryway 14. The readers 12 communicate with a programmable electronic controller 16 which generates a signal for controlling access to a restricted area, such as via an electromagnetic lock 18.

Access to the restricted area is automatically obtained by means of an electronic key 20 in the form of a compact data carrier. The key 20 is inserted into an input receptacle 22 of a reader module 12. Upon contact, data is input from the key 20 to the controller 16. The controller has a programmable processor which is programmed to determine whether the data constitutes a valid password or code for permitting access to the restricted area. The reader module 12 typically has two pin sockets 23 for communicating via two leads with a programmer. Each reader module 12 also preferably has an LED 24 which provides a visual indication that the key 20 is communicating with the reader module 12.

Electronic key 20 preferably is a data carrier which includes a coin-like steel case 26. The case houses a ROM (read-only memory) chip 30. The key 20 may be mounted to a fob 28, a card, a clip or another accessory to facilitate retention and manual manipulation of the key. A preferred embodiment of the key 20 is a DS 1990 Touch Serial Number data carrier marketed by Dallas Semiconductor. The key ROM chip 30 is a 64 bit ROM which essentially functions as an electronic password for automatic identification. Data from the ROM chip 30 is transferred serially via a one wire protocol to the mating receptacle 22. Alternately, the key 20 may have a RAM (random-access memory), EPROM (erasable programmable read-only memory) or EEPROM (electrically erasable programmable read-only memory) chip.

It should be appreciated that in accordance with the present invention, the reader module 12 and controller 16 may be employed in applications such as an inventory control system, a personnel tracking system, a tool management system and numerous applications other than the access control system 10.

The data from the ROM chip 30 is accessed via a single data line which employs a one wire protocol. The key essentially functions as a slave which cooperates with the bus master of the controller or micro controller 16. The memory map of the ROM chip 30 typically may have an 8 bit CRC code, a 48 bit serial number and an 8 bit family code.

For a given system, there may be as many as hundreds of electronic keys 20 which have a ROM chip 30 fixed with a unique data code. The controller is initially programmed to accept a pre-established subset of the entire group of the codes. As the set of authorized users increases and additional keys are issued, the controller is updated or programmed to include verification information for the newly issued keys so that the new keys may provide access to the restricted area. If a given key which has previously been issued, has been lost or it is otherwise desired to delete access for a given key, the controller is also programmed to process the data input by the key so that the given password no longer is a valid password.

In accordance with the invention, a programmer 50 is employed to program the controller 16 by interfacing through the reader module 12. The programmer 50 is a compact hand-held device which connects via two leads 52 with the pin socket 23 of the reader module for programming the controller. For example, the programmer may input data as new keys are issued so that the new keys will be accepted by the controller and or the programmer may input data so that certain previously coded keys may be deleted from the system and no longer provide authorized access as previously described. The programmer also may be employed to accomplish various other programming tasks.

With reference to FIGS. 2 through 10, the programmer 50 has a rigid housing formed from a cover 54 which mounts onto a base 55. A keypad 56 is located at one side of the top face of the housing. The keypad 56 may include a series of depressible buttons or a membranetype keyboard as illustrated. Essentially six input keys 58*a–f* defined at discrete locations of the membrane are employed for the illustrated keypad 56. An input port or receptacle 60 disposed at the cover of the housing receives and mates with a key 20.

The keypad 56 has a membrane 62 which overlays switches 64*a–f*. The switches 64 communicate via circuitry affixed to a circuit board 65. The keypad, switches and associated circuitry may be manufactured as a compact unit and mounted to the circuit board and electrically connected by pin connectors. The switches 64 are spring biased and are responsive to external depressible contact against the keys 58 to close an electrical contact to thereby address a corresponding ROM chip 66*a–f* mounted to the circuit board 65. The chips 66 are fastened in position to the circuit board 65 by resilient sockets 67 which are mounted through openings in the circuit board. A preferred socket is a Version DS 9094 microcan clip manufactured by Dallas Semiconductor. The ROM chips are preferably identical in form and function to the data carriers which are employed as the keys. Each of the ROM chips 66 are pre-coded with an elemental data code which corresponds to the keypad designation. The signals applied to the corresponding ROM chips 66 enable the data to communicate via the wire leads 52 which connect with the reader module 12. Thus, the programmer 50 essentially functions to closely replicate the data format of contacting a key 20 in the input receptacle 22 of the reader module 12.

The circuit board 65 is spaced from the base 55 by cylindrical stand-off supports 57. Fasteners 59 extend through the supports 57 (FIG. 8) to secure the circuit board to the base. A metal plate 69 (FIG. 7) is positioned between the circuit board and the base below the keypad 56 to enhance the structural support of the keypad assembly.

A tandem pin-type terminal plug 61 for mating with the female connector of leads 52 mounts to the circuit board and is accessed through the front of the cover.

The programmer receptacle 60 may be employed so that a key may be relatively easily deleted or added to the control system. For example, a key to be added may be placed in the receptacle 60, and a command, which is implemented by pressing one or a sequence of keys 58, may be given. The LED 24 at the reader also indicates visually that the key has been entered into the system or changed or deleted. Typical commands for the programmer are illustrated in FIG. 11. Pass codes to be added, deleted or changed may also be entered directly through the keypad 56.

Flow charts which illustrate the procedures for communicating between the programmer 50 and the controller 16 and for enabling the processing of the data are illustrated in FIGS. 12 through 15.

Figure 12:
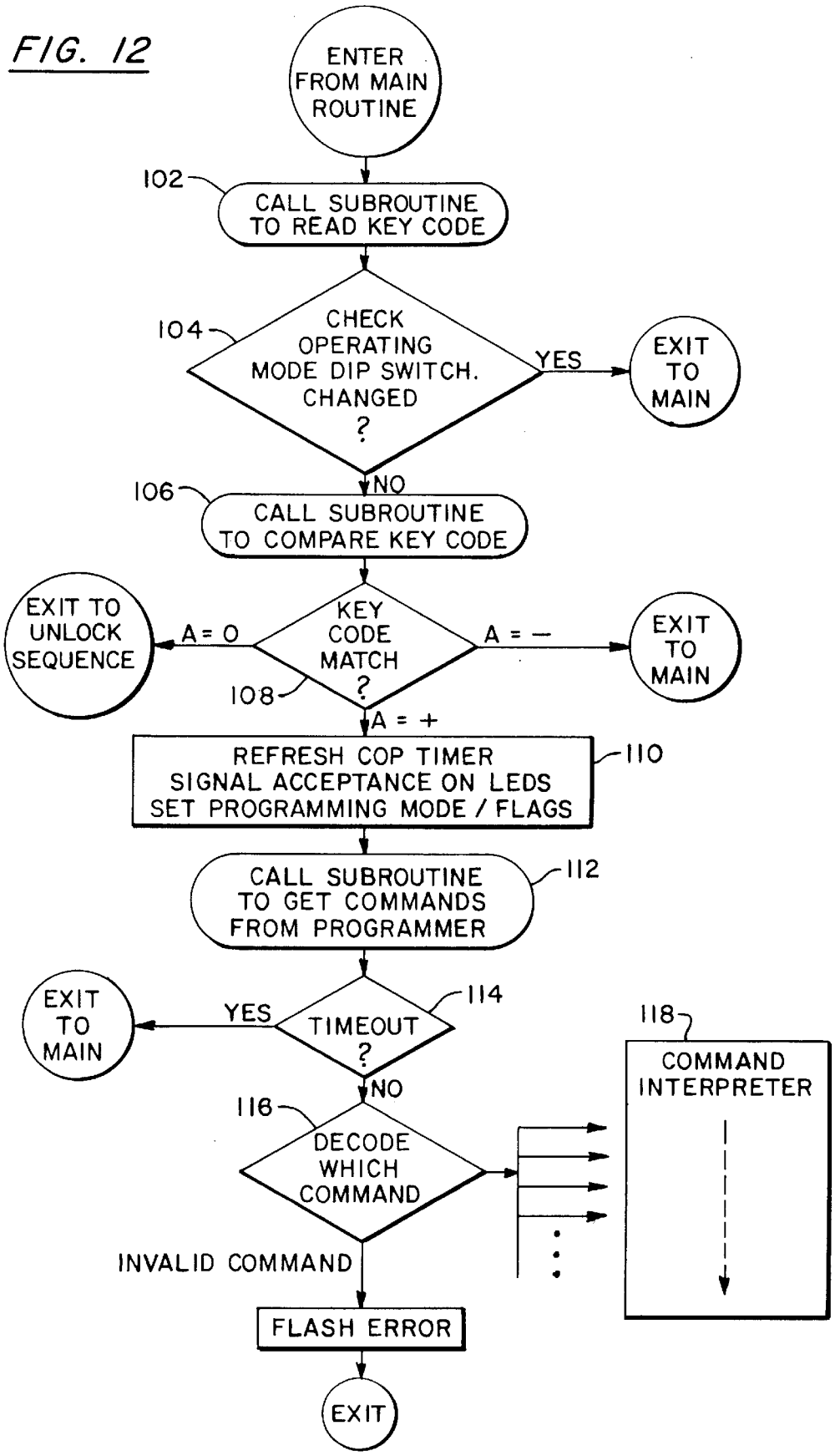
FIG. 12 is a flow chart illustrating a routine for initiating communication by the programmer in accordance with the present invention.

With reference to FIG. 12, the data from the key 20 is read, and a verification sub-routine is undertaken to verify that the data was read correctly. If the data input program (DIP) switch is changed, then the program returns to normal operation for a new configuration. If the DIP switch is not changed, then the data is read from the key 20 and processed with the data previously stored in the electrically erasable programmable read-only memory (EEPROM) of the controller 16. This subroutine returns with the status of one of three results as set forth in Table 1 below.

TABLE I

| |
|---|
| A = 0 no match |
| A = + master code match |
| A = − useer code match |

If an invalid code is identified, the program exits and returns to normal operation or waits for the entry of the next key. If the key has a valid code, then the controller generates a signal to unlock the electromagnetic lock 18. Other information such as the identity of the user and the time may also be recorded.

If a master key is accepted, the controller 16 enters a programming mode where the functions are performed as required and the LED 24 is appropriately activated. The controller 16 then interfaces with the programmer 50. If too much time has passed without receiving a valid command from the programmer 50, the controller returns to the normal operation. Otherwise, the controller performs the command functions input from the programmer as further set forth in FIGS. 13–15.

Figure 13:
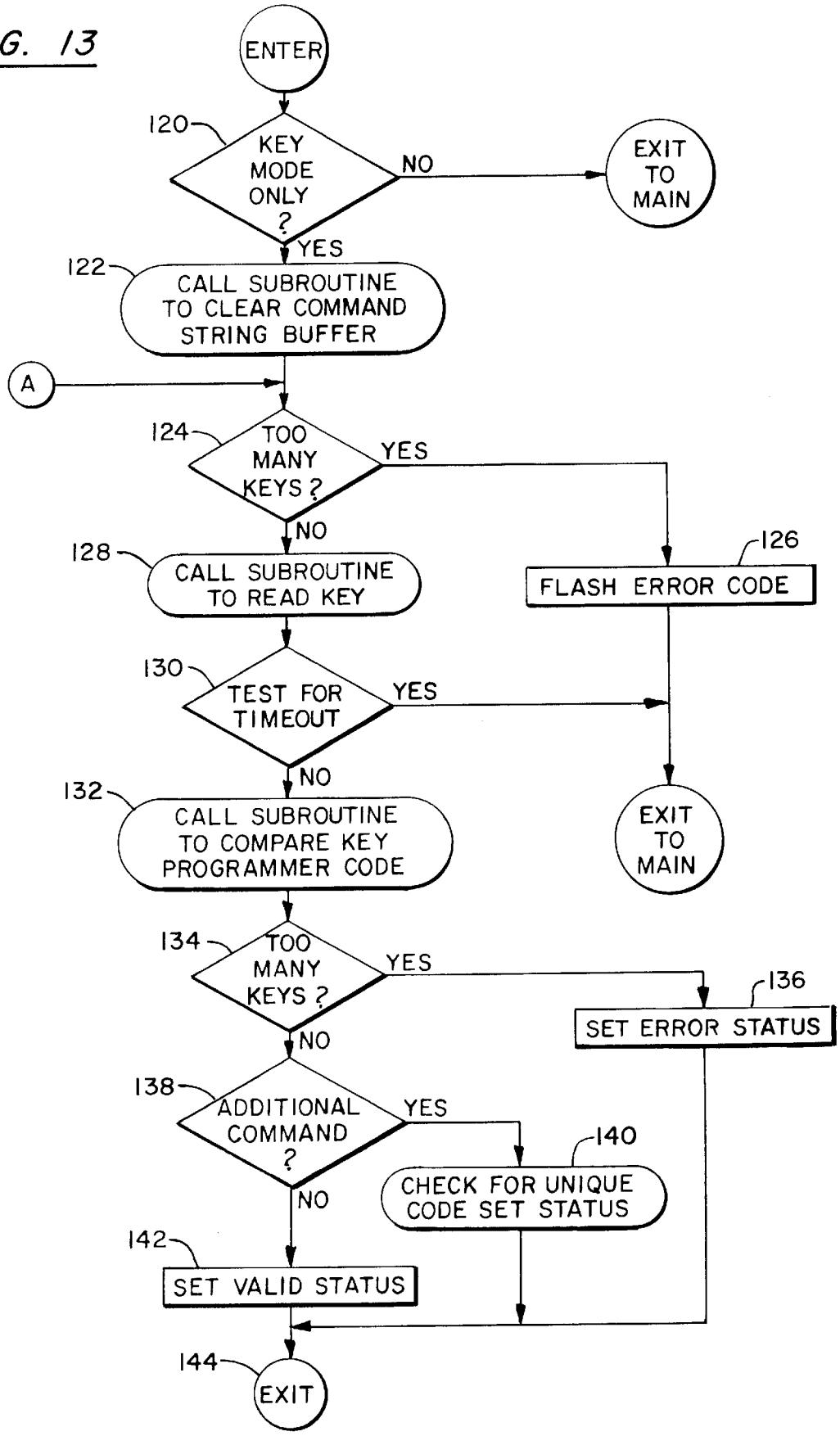
FIG. 13 is a flow chart illustrating a routine by the programmer of FIG. 1.

With reference to FIG. 13, if the DIP switch is not in a normal reader only mode, then a flag is set and the subroutine exits. Otherwise, a command string buffer is cleared. If the command string entry exceeds the maximum valid command string length, an error is recorded and the subroutine exits. The processor then reads the password and verifies that the password was read correctly. If too much time elapses, then the sub-routine exists.

The procedure for processing the password and comparing it with programmer code stored in the EEPROM of the controller 16 is illustrated in FIGS. 14 and 15. The program then checks for errors, sets a return status and exits.

With reference to the comparison routine of FIG. 14, the program starts with the first byte of the passcode and the first programmer code stored in the EEPROM of the controller to be read from the EEPROM, and a determination is made whether there is a match. If the data is a first byte, a sub-routine ensures that it is a valid password-type format. The comparison search is replicated until all of the password bytes and the EEPROM programmer codes have been compared. If there are no valid matches, a zero or no match status is recorded, and the program exits.

If the password code matches the EEPROM code, the next process is to identify the keypad digit. The asterisk (key 58*f*) is used as a delimiter that is not entered into the command stream, so that the asterisk terminates the command entry. With reference to FIG. 15, if the digit is an asterisk, the overhead functions are performed, and the digit is shifted onto the command stream. If the key is released, the pass code is removed from the reader. The LED 24 is then de-energized. The entry is complete, and the next digit is processed as set forth in FIGS. 14 and 15. The command has thus been successfully entered in the command stream operation which completes the return for a normal process.

Figure 16:
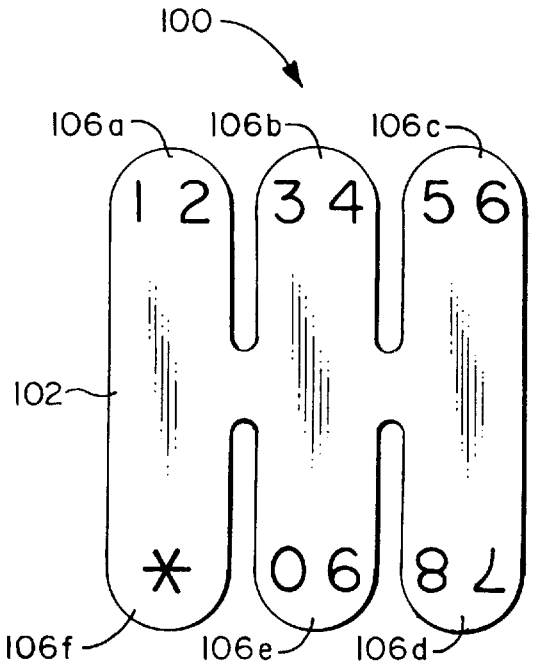
FIG. 16 is a top plan view of a second embodiment of a programmer in accordance with the present invention.
Figure 18:
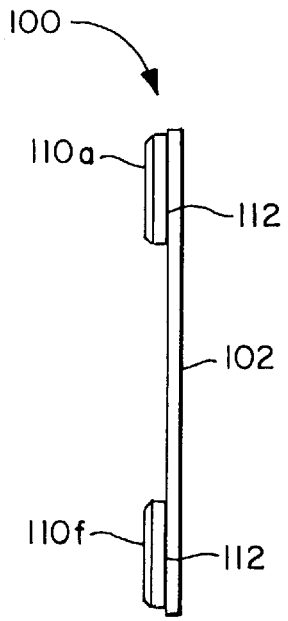
FIG. 18 is a side view of the programmer of FIG. 16 viewed from the left thereof.
Figure 17:
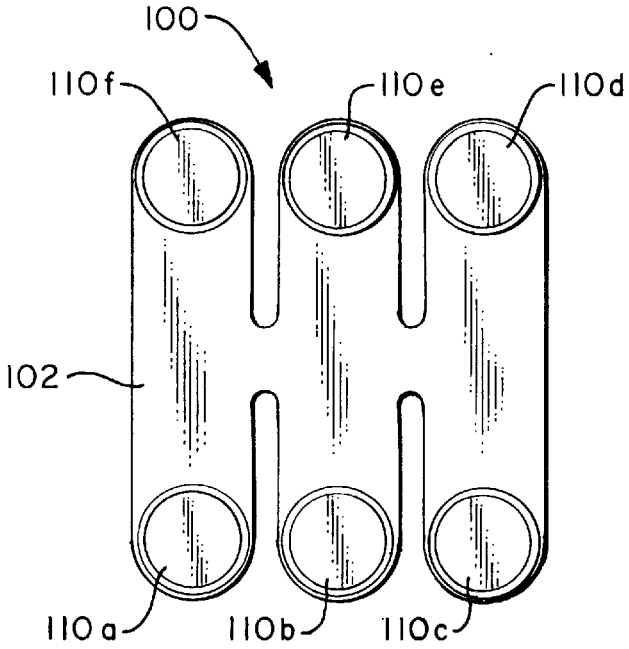
FIG. 17 is a bottom view of the programmer of FIG. 16.

With reference to FIGS. 16 through 18, a compact programmer is generally designated by the numeral 100. Programmer 100 employs a flexible card or board 102 having the shape of three opposed pairs of fingers. The card 102 may have a vinyl plastic composition. The top distal surfaces of the fingers are affixed with key board identification indicia 106*a–f*, such as illustrated in FIG. 16. The underside of each of the fingers mounts carriers 11O*a–f* each having a unique ROM chip corresponding to the indicia 106*a–f* data. The carriers 110 are retained to the board 102 by means of double-sided tape 112 or other adhesive. The carriers 110 are similar in form and function to the data carriers employed as keys 20. Each of the chips is affixed with a unique data code which corresponds to the corresponding key indicia 106*a–f*on the top of the card 102.

Programming is physically accomplished via programmer 100 by sequentially positioning a carrier 110 (having a chip which corresponds to a given key or elemental code designation) in the input receptacle 22 of the controller. The program defines the specific chip and sequence. Representative commands are set forth in FIG. 11. The card is sufficiently flexible and the fingers sufficiently spaced to allow insertion of the appropriate carrier without interference from the rest of the programmer body.

Figure 19:
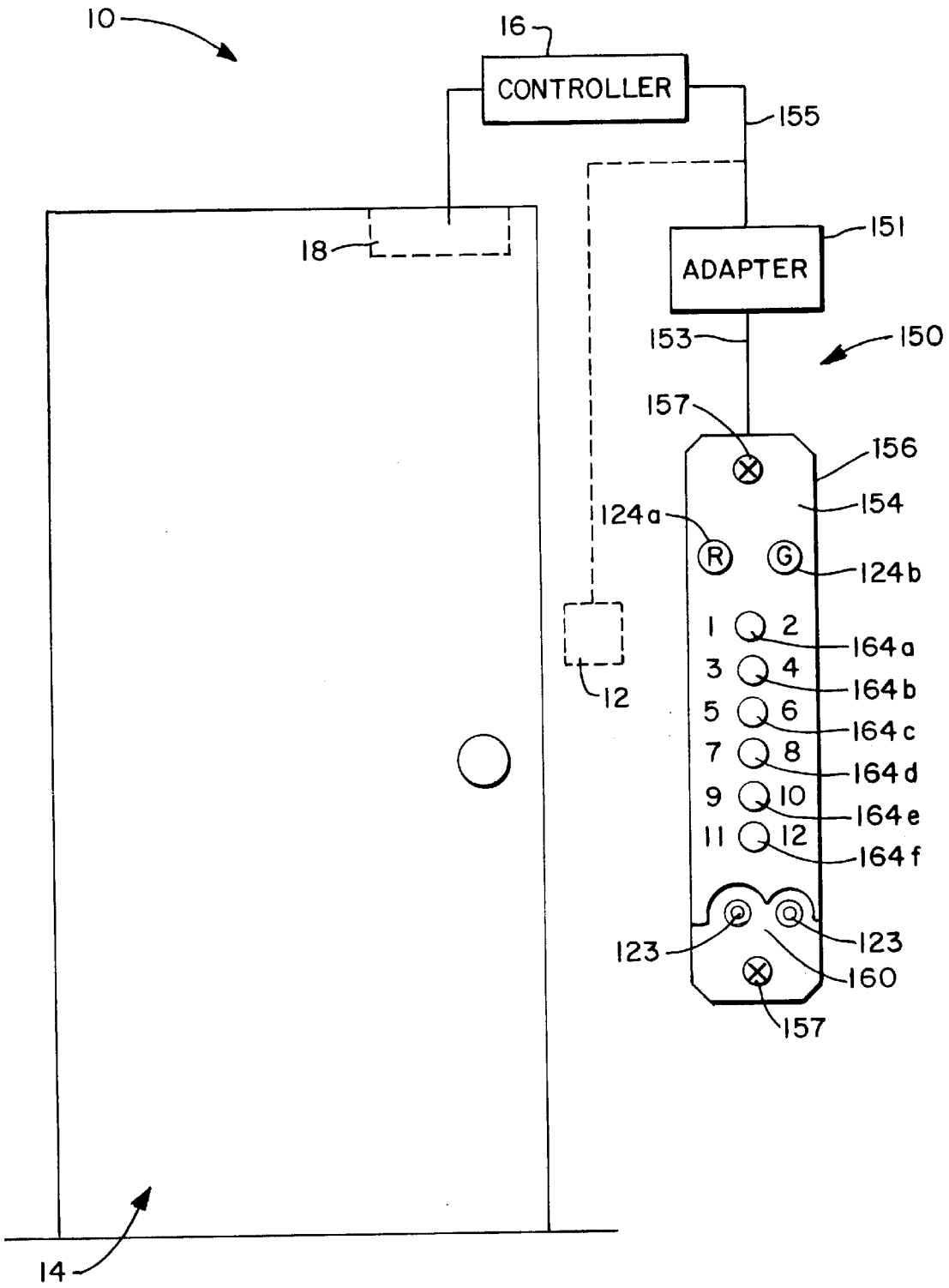
FIG. 19 is a schematic diagram of an access control system having a keypad and employing a permanent programmer in accordance with the present invention.
Figure 20:
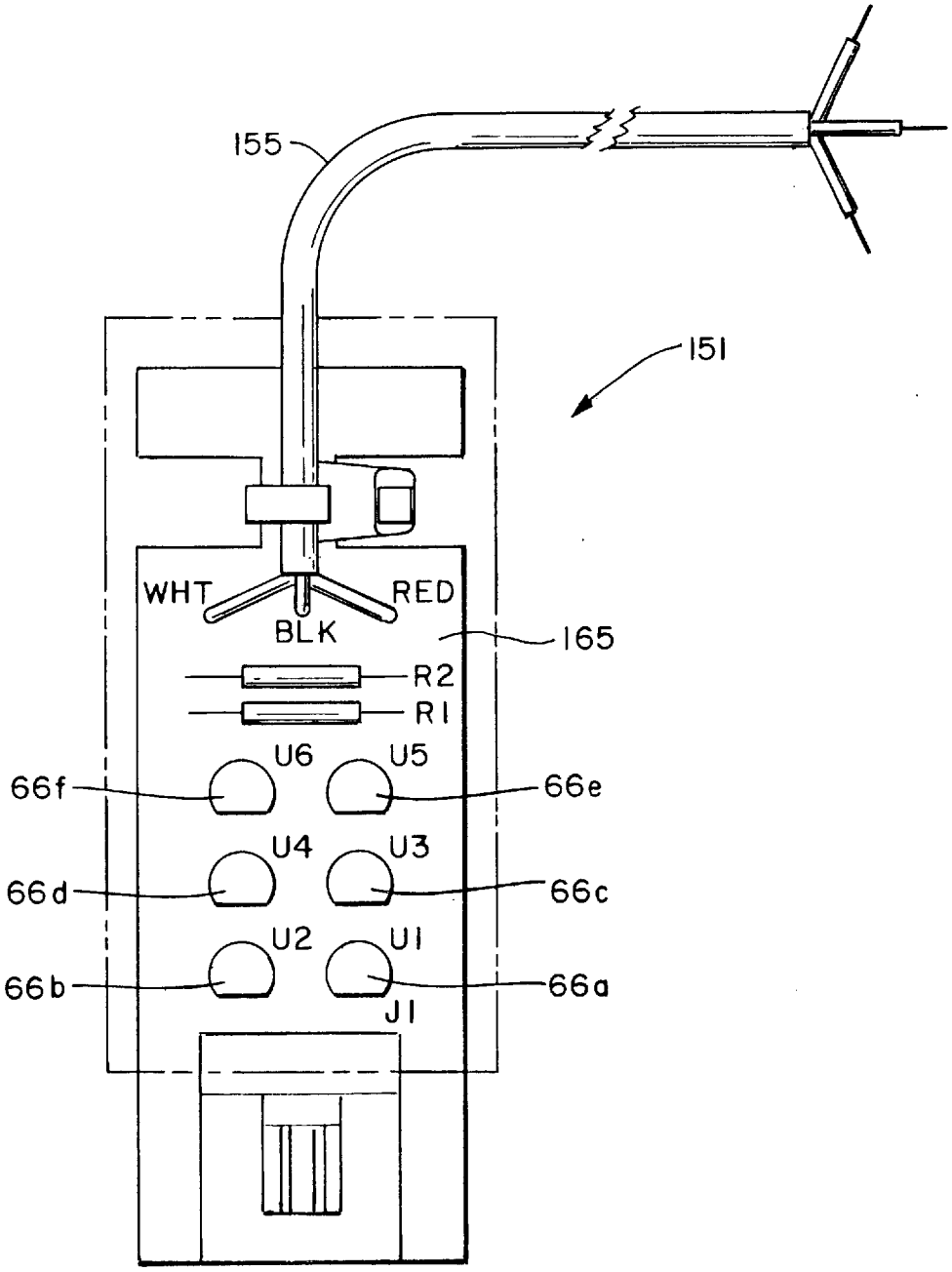
FIG. 20 is an enlarged schematic view of an adapter module employed in the access control system of FIG. 19.
Figure 21:
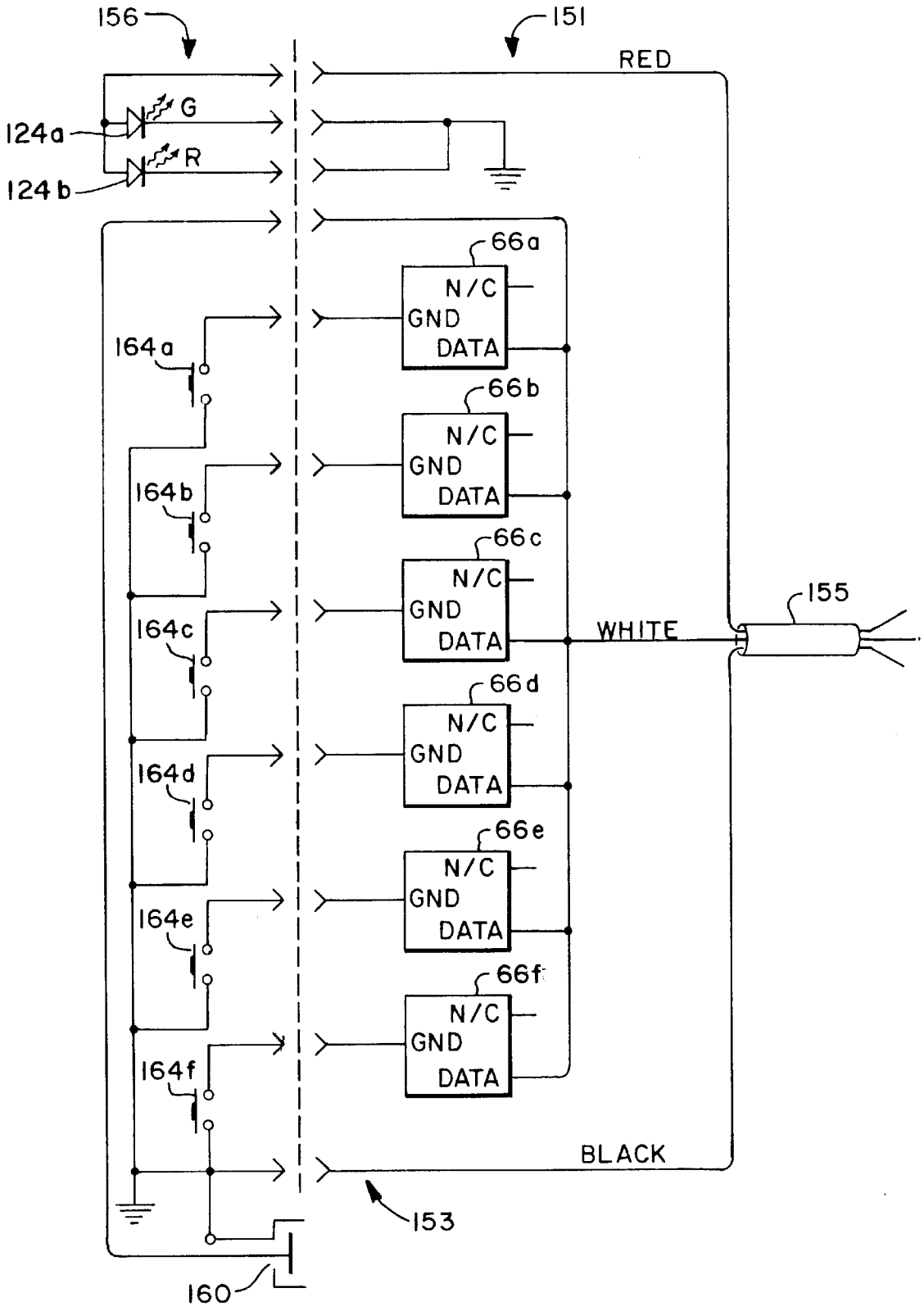
FIG. 21 is a schematic diagram for the circuitry of the programmer of FIG. 19.

With reference to FIGS. 19 thru 21, a permanent programmer retrofit kit for programming the programmable electronic controller 16 by means a programmer permanently mounted at the door site, is generally designated by the numeral 150. The permanent programmer 150 has an adapter module 151 and a keypad 156. The permanent programmer 150 is adapted to incorporate a permanent programmer into a pre-existing programmable entry control system as generally shown in FIG. 1. The permanent programmer 150 is also capable of transmitting personal identification codes to the input of the controller 16. The permanent programmer 150 is generally intended to replace at least one of the reader modules 12. For a lower cost system wherein the permanent programmer will only be employed for programming and not the entry of personal identification codes, only a single keypad 156 is located at the site of the doorway 14. A conventional data port 12 can be positioned on the opposite side of the doorway 14 from the keypad 156. The programmer 150 is in permanent electrical connection with the controller 16.

The adapter module 151 is preferably permanently located in the vicinity of the location of the key pad 156. The adapter module 151 has a circuit board 165 for supporting six ROM chips 66*a–f*. The chips 66*a–f* are fastened in position to the adapter by resilient sockets 67 previously identified for the programmer 50. Preferred embodiments of the chips 66*a–f* are DS 2401 chips marketed by Dallas Semiconductor of Dallas, Texas. The ROM chips 66*a–f* function to program the controller 16 in the same manner as described above.

The keypad 156 has a housing 154 which is fixedly mounted adjacent to the doorway 14 by mounting screws or bolts 157 which extend through the housing 154. Six depressible keys 164*a–f* are mounted for activation at the front of the housing 154. The keys 164*a–f* are spring biased and are responsive to external pressure activation to close an electrical contact. Closing the electrical contact of one of the keys 164*a–f* electrically connects the corresponding ROM chip 66*a–f* to the input of the controller. Address wiring 153, comprising the internal wiring of the keypad 156, the internal wiring of the adapter module 151 and a multistrand conductor therebetween, is employed to address the chips 66*a–f* by use of the keys 164*a–f*. A three conductor communication cable 155 carries the unique code of the addressed chip 66*a–f* from the address wiring 153 to the input of the controller 16. (See FIG. 21)

The housing 154 of the keypad 156 further preferably supports a contact activatable reader 160 for receiving electronic keys 20. Contact of a key 20 to the reader 160 communicates the code of the key to the input of the controller. The access control system functions as previously described on receiving the code of the keys 20. For systems where both reader modules 12 are retained, the reader 160 is not required.

The reader 160 also defines tandem pin sockets 123 to allow access to the controller 16 by a portable programmer. Therefore, simpler programming can be accomplished by use of the keypad 156. The programmer 150 programs the controller 16 in the same manner as previously described for the programmer 150. More complicated programming can be performed by a more sophisticated portable programmer using the pin sockets 123.

In a further embodiment of the invention, personal identification codes are transmitted to the input of the controller 16 by the programmer 150. A series of entries on the keys 164*a–f*, different from the program command functions shown for example in FIG. 11, adds an additional level of security to the access control system. A personal identification code of a sequence of the unique codes of the programming chips 66*a–f* is recognizable by the controller 16. The controller 16 compares the entered personal identification code to stored personal identification codes and generates a signal in response to the comparison. Therefore, the user of the access control system would require both an electronic key 20 and the personal identification code to be allowed access.

The controller 16 stores in memory, for each door user, an electronic code or password from a key 20 and a corresponding personal identification code. In order to open the lock 10, a door user contacts a key 20 to the reader 160 and enters a corresponding personal identification code by manipulation of the keypad 156. The controller 16 then compares both the entered electronic code and entered personal identification code to the preprogrammed valid codes and generates a signal to unlock the electromagnetic lock 18 when both codes are valid. The controller 16 can also be configured to unlock the electromagnetic lock 18 on reception of either a valid password or a personal identification code. The keypad 156 further supports a pair of red and green LEDs 124*a*, 124*b* to indicate the status of the entry control system.

Additional programmer embodiments (not illustrated) may employ a board having six arcuately spaced recesses. Chips are positioned in the recesses so as to be arranged in a circular array. The contact surfaces of the ROM chips extend below the board. The chips are permanently affixed to the board. Each of the chips is identified. The programming is physically accomplished by manipulating the board so that commands can be input into the reader by contacting the chips against the reader receptacle according to the pre-established program. In another programmer embodiment, the chips are removably mounted to a board and sequentially removed from the board form direct contact in the input receptacle of the reader as required.

While preferred embodiments of the invention have been set forth for purposes of illustration, the foregoing description should not be deemed a limitation of the invention herein. Accordingly, various modifications, adaptations and alternatives may occur to one skilled in the art without departing from the spirit and the scope of the present invention.

We claim:

1. A programming and input signal device for programming and transmitting input signals for a programmable processor of a door security system, said device comprising:

key pad means for defining a key pad having a plurality of keys;

code means comprising a plurality of contact activatable data carriers, each data carrier having a conductive case and a data chip enclosed in said case, each data chip fixed with a unique elemental code, said code transmitted through said case;

address means for addressing said chips by said keys, said chips and said keys being configured in one-to-one correspondence; and communication means for communicating the elemental code of an addressed chip to said programmable processor.

2. The programming and input device of claim 1 further comprising receptacle means on said keypad for receiving an electronic key having a code.

3. The programming and input device of claim 1 further comprising an adapter module having a board and a plurality of resilient sockets fixed to said board, said code means mounted to said sockets.

4. An entry control system for controlling access to an area comprising:

a programmable electronic controller for storing electronic passwords and personal access codes and comparing inputted electronic passwords and personal access codes to said stored electronic passwords and personal access codes, and signal means for generating a release signal in response to said comparison, said controller programmable by a program code;

data reader means for reading stored electronic passwords, said data reader means comprising port means for providing a contact activatable data port for transmitting electronic passwords to said controller;

key means comprising a data chip having an electronic password communicable with said controller upon contact with said data port means;

programmer and code means communicable with said controller for transmitting said program code to said controller and for receiving personal access codes and transmitting said personal access codes to said controller, said programmer and code means comprising a plurality of contact activatable program chips each enclosed in a conductive case and having a unique elemental code, said code transmitted through said case, and key pad means comprising keys and address means for selectively addressing each program chip, said program code and said personal access codes comprising said elemental codes.

5. The entry control system of claim 4 wherein said programmer and code means has six program chips.

6. The entry control system of claim 4 wherein said key pad means comprises six electrical switches.

7. The entry control system of claim 4 wherein said keypad means comprises electrical switches, said switches addressing said program chips in one to one correspondence.

8. An entry control system for controlling access to an area comprising:

controller means comprising input means for receiving an input signal, programmable processor means communicable with said input means for establishing a passcode, comparison means for comparing an input code applied to said input means to said passcode, and signal means for selectively generating an output signal in response to said comparison;

data reader means for reading electronically recorded data, said data reader means comprising input port means for providing a contact activatable data port for communicating with said input means;

key means comprising a data chip having a code communicable with said controller means upon contact with said port means; and programmer means comprising a plurality of program chips each enclosed in a case and having a unique elemental code, each said unique elemental code being communicable with said input means for programming said processor means to redefine said passcode.

9. The entry control system of claim 8 wherein said programmer means is permanently connected with said processor means.

10. The entry control system of claim 8 wherein said programmer means further comprises keypad means for selectively addressing each of said program chips.

11. The entry control system of claim 9 wherein said keypad comprises a plurality of electrical switches, said switch addressing said program chips in one to one correspondence.

12. The entry control system of claim 9 further comprising mounting means for mounting said programmer means to a surface.

13. The entry control system of claim 9 wherein said processor means is communicable with said program chips are communicable with said input means for entering personal identification codes to said processor means.

14. The entry control system of claim 9 wherein said keypad means further comprises a membrane overlying a plurality of electrical switches corresponding to each of said program chips.

15. The entry control system of claim 10 wherein each electrical switch is in one to one correspondence with one said program chip.

16. The entry control system of claim 8 wherein said programmer means further comprises receptacle means for defining a contact activatable data port which is communicable with said key means.

17. The entry control system of claim 8 further comprising a housing and said programmer means and said data reader means mounted in said housing.

18. The entry control system of claim 8 wherein said program chips are arranged in a linear array.

19. The entry control system of claim 8 wherein said programmer means comprises board means for forming a support board and said program chips are mounted to said board means.

20. The entry control system of claim 19 wherein said program chips are ROMS.

* * * * *